US009004943B2

(12) United States Patent
Johnescu et al.

(10) Patent No.: US 9,004,943 B2
(45) Date of Patent: Apr. 14, 2015

(54) ELECTRICAL CONNECTOR HAVING ELECTRICALLY INSULATIVE HOUSING AND COMMONED GROUND CONTACTS

(75) Inventors: Douglas M. Johnescu, York, PA (US); Jonathan E. Buck, Hershey, PA (US)

(73) Assignee: FCI Americas Technology LLC, Carson City, NV (US)

( * ) Notice: Subject to any disclaimer, the term of this patent is extended or adjusted under 35 U.S.C. 154(b) by 233 days.

(21) Appl. No.: 13/519,419

(22) PCT Filed: Dec. 17, 2010

(86) PCT No.: PCT/US2010/061010

§ 371 (c)(1), (2), (4) Date: Oct. 4, 2012

(87) PCT Pub. No.: WO2011/090634

PCT Pub. Date: Jul. 28, 2011

(65) Prior Publication Data

US 2013/0052843 A1 Feb. 28, 2013

Related U.S. Application Data

(60) Provisional application No. 61/291,015, filed on Dec. 30, 2009.

(51) Int. Cl.

| | |
|---|---|
| ***H01R 13/648*** | (2006.01) |
| ***H01R 13/6471*** | (2011.01) |
| ***H01R 13/658*** | (2011.01) |
| ***H01R 13/6585*** | (2011.01) |
| *H01R 13/6461* | (2011.01) |

(52) U.S. Cl.
CPC ..... *H01R 13/65807* (2013.01); *H01R 13/6461* (2013.01); *H01R 13/6471* (2013.01); *H01R 13/6585* (2013.01)

(58) Field of Classification Search
USPC ..... 439/607.1, 607.05, 607.07
See application file for complete search history.

(56) References Cited

U.S. PATENT DOCUMENTS

| | | | | |
|---|---|---|---|---|
| 6,123,584 | A | 9/2000 | Van Koetsem et al. | |
| 6,168,469 | B1 | 1/2001 | Lu | |
| 6,471,548 | B2 * | 10/2002 | Bertoncini et al. | 439/607.1 |
| 6,478,624 | B2 * | 11/2002 | Ramey et al. | 439/607.1 |
| 6,485,330 | B1 | 11/2002 | Doutrich | |
| 7,371,117 | B2 | 5/2008 | Gailus | |
| 7,381,092 | B2 * | 6/2008 | Nakada | 439/607.1 |
| 7,722,399 | B2 * | 5/2010 | Scherer et al. | 439/607.05 |
| 7,736,183 | B2 * | 6/2010 | Trout et al. | 439/607.1 |
| 7,811,100 | B2 | 10/2010 | Stoner | |
| 7,811,134 | B2 | 10/2010 | Bixler et al. | |
| 7,997,934 | B2 | 8/2011 | Bixler et al. | |
| 8,202,118 | B2 * | 6/2012 | Cohen et al. | 439/607.1 |
| 2008/0096424 | A1 | 4/2008 | Bixler et al. | |
| 2009/0011645 | A1 | 1/2009 | Laurx et al. | |
| 2009/0221165 | A1 | 9/2009 | Buck et al. | |

* cited by examiner

*Primary Examiner* — Hien Vu
(74) *Attorney, Agent, or Firm* — Baker & Hostetler LLP

(57) ABSTRACT

An electrical connector is provided having an electrically insulative connector housing that supports a plurality of signal contacts, as well as a plurality of ground contact networks. The ground contact networks include a conductive ground coupling bar supporting a plurality of ground contacts along a pair of columns that are spaced apart along a row direction.

19 Claims, 9 Drawing Sheets

ELECTRICAL CONNECTOR HAVING ELECTRICALLY INSULATIVE HOUSING AND COMMONED GROUND CONTACTS

CROSS-REFERENCE TO RELATED APPLICATIONS

This application is the National Stage of International Application No. PCT/US2010/061010 filed Dec. 17, 2010, which claims the benefit of U.S. Provisional Application No. 61/291,015 filed Dec. 30, 2009, the disclosures of which are incorporated herein by reference in their entireties.

BACKGROUND

Electrical connectors typically include a plurality of signal contacts and ground contacts. Often, the signal contacts are so closely spaced that undesirable interference, or "cross talk," occurs between adjacent signal contacts. Cross talk occurs when one signal contact induces electrical interference in an adjacent signal contact due to intermingling electrical fields, thereby compromising signal integrity. With electronic device miniaturization and high speed, high signal integrity electronic communications becoming more prevalent, the reduction of cross talk becomes a significant factor in connector design.

SUMMARY

In accordance with one embodiment, an electrical connector includes an electrically insulative connector housing, a plurality of signal contacts supported by the connector housing, and a ground contact network. The ground contact network includes an electrically conductive ground coupling bar defining first and second opposed sides, and a plurality of ground contacts mounted to the first and second sides of the ground coupling bar in first and second respective columns. The ground coupling bar places each of the plurality of ground contacts mounted to the first side in electrical communication with each other, further places each of the plurality of ground contacts mounted to the second side in electrical communication with each other, and further places each of the plurality of ground contacts mounted to the first side in electrical communication with each of the plurality of ground contacts mounted to the second side. The electrically conductive ground coupling bar helps to reduce crosstalk between differential signal pairs along the respective columns, and helps to reduce crosstalk between differential signal pairs in a direction perpendicular to the columns.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION

Figure 1A:
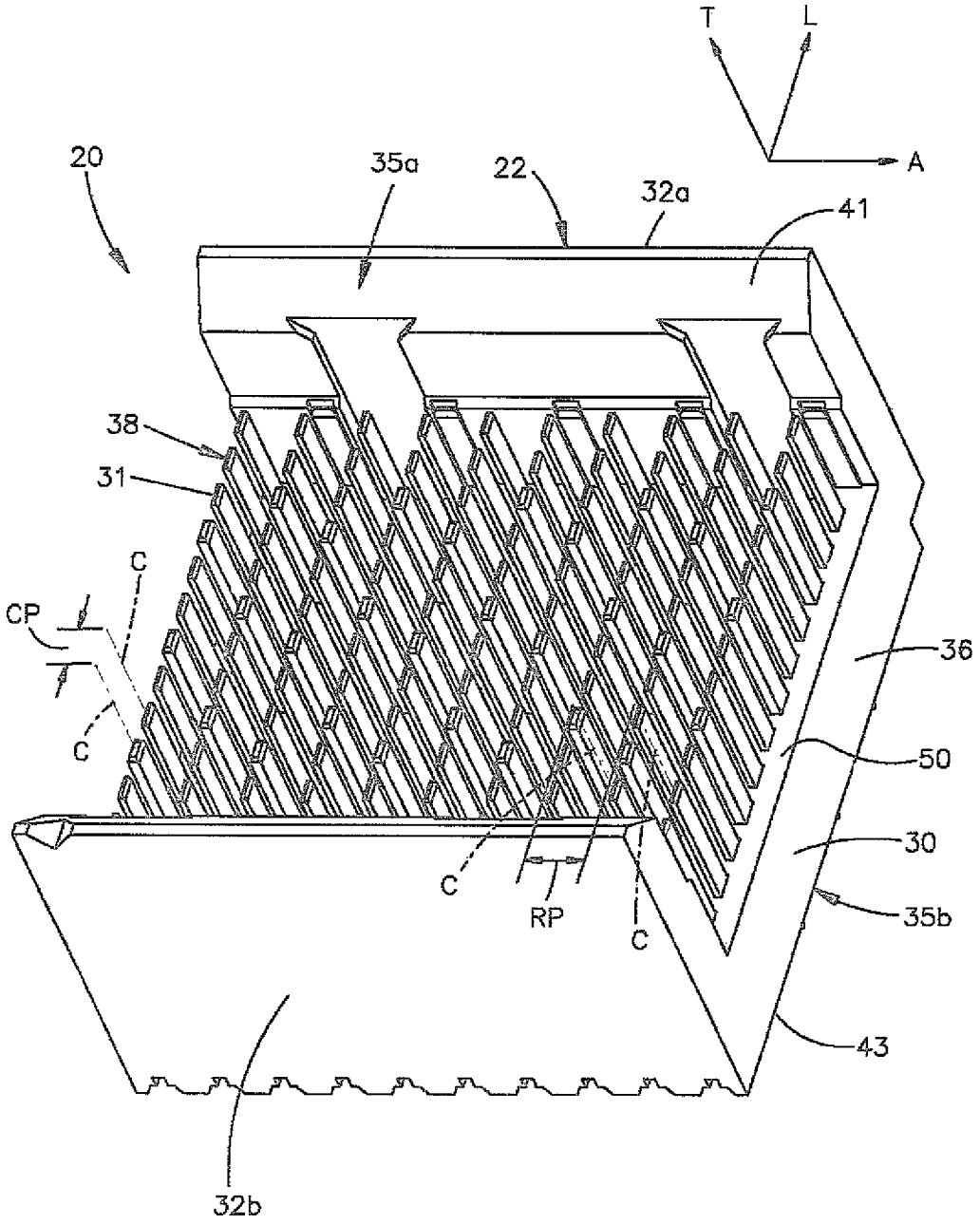
FIG. 1A is a perspective view of an electrical connector constructed in accordance with one embodiment, including a connector housing supporting a plurality of electrical signal and ground contacts.
Figure 1B:
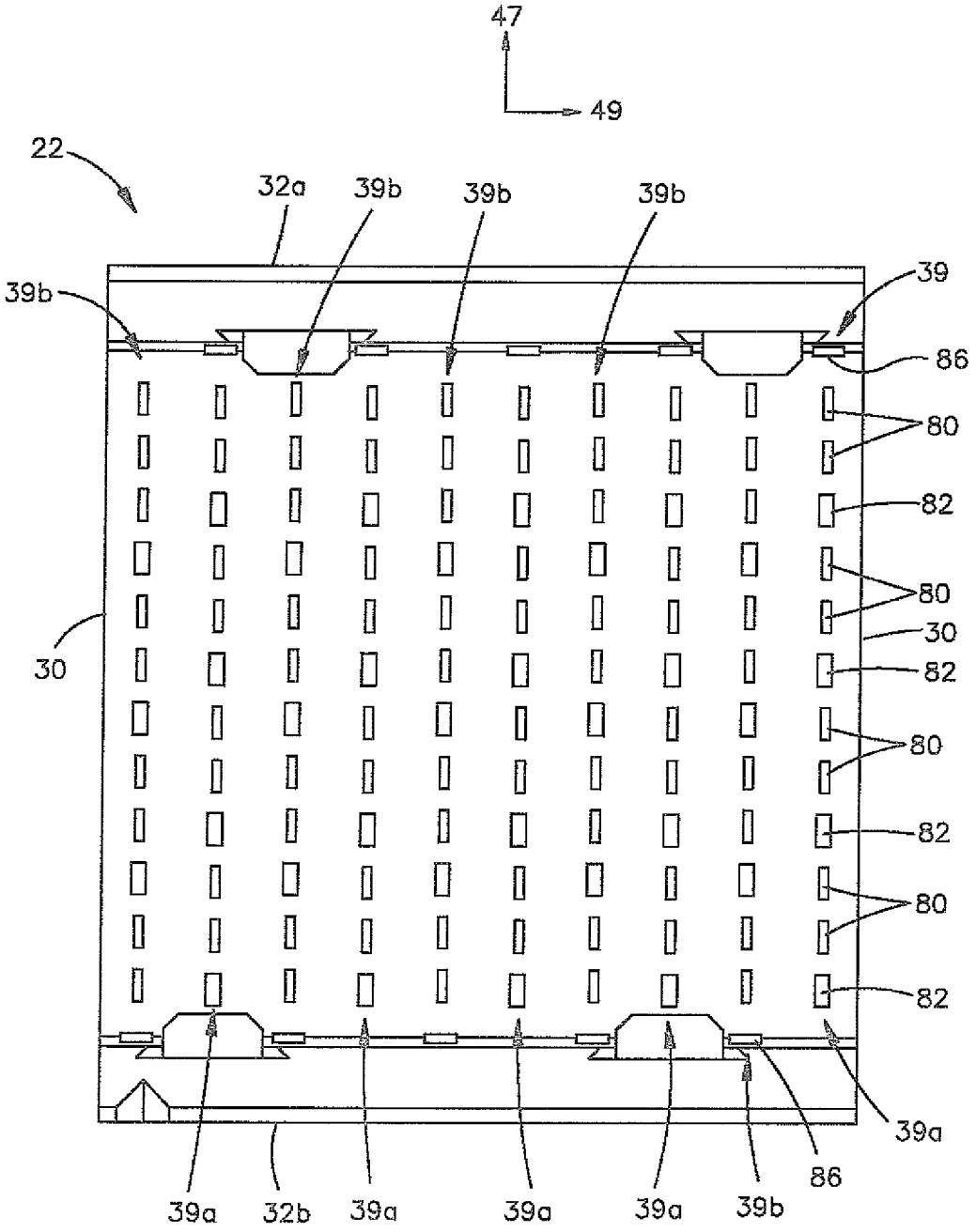
FIG. 1B is a top plan view of the connector housing illustrated in FIG. 1A.
Figure 1C:
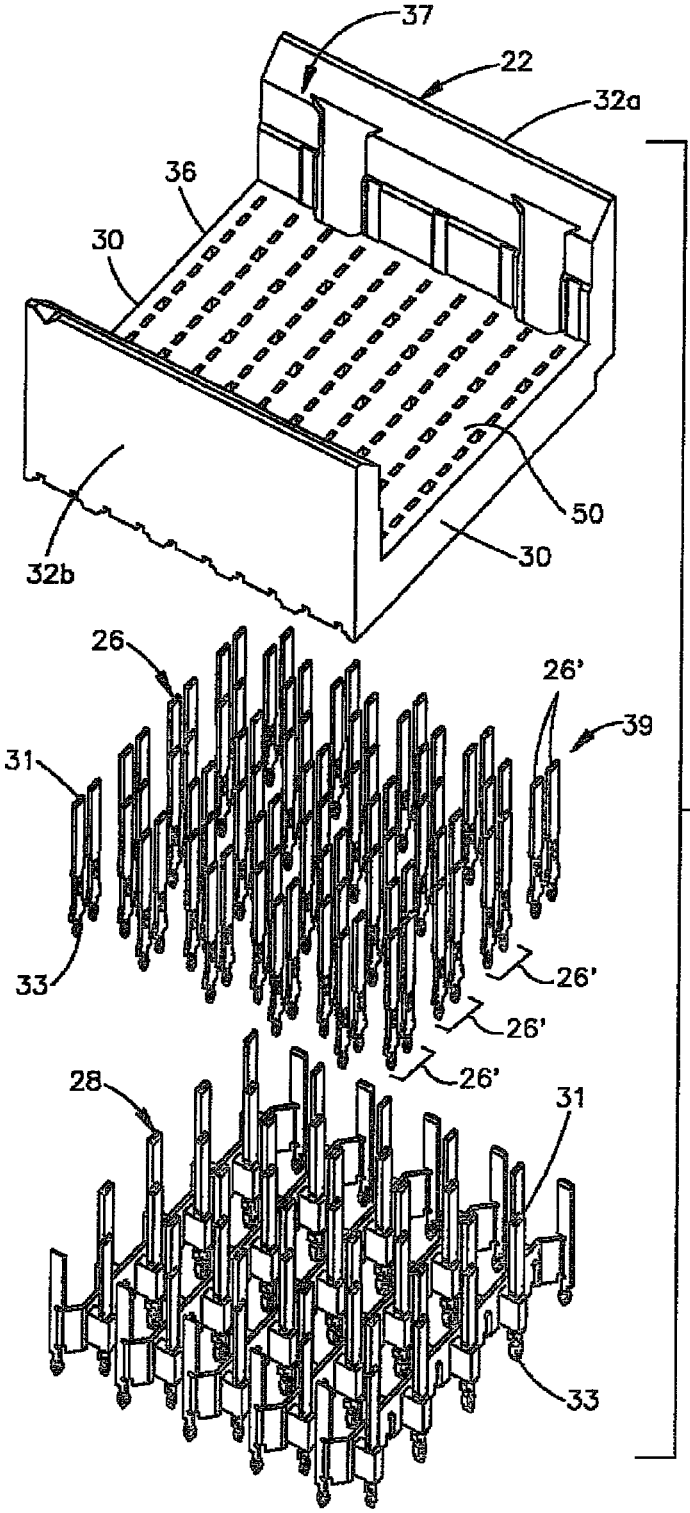
FIG. 1C is an assembly view of the electrical connector illustrated in FIG. 1A, further showing a plurality of ground contact networks.
Figure 2:
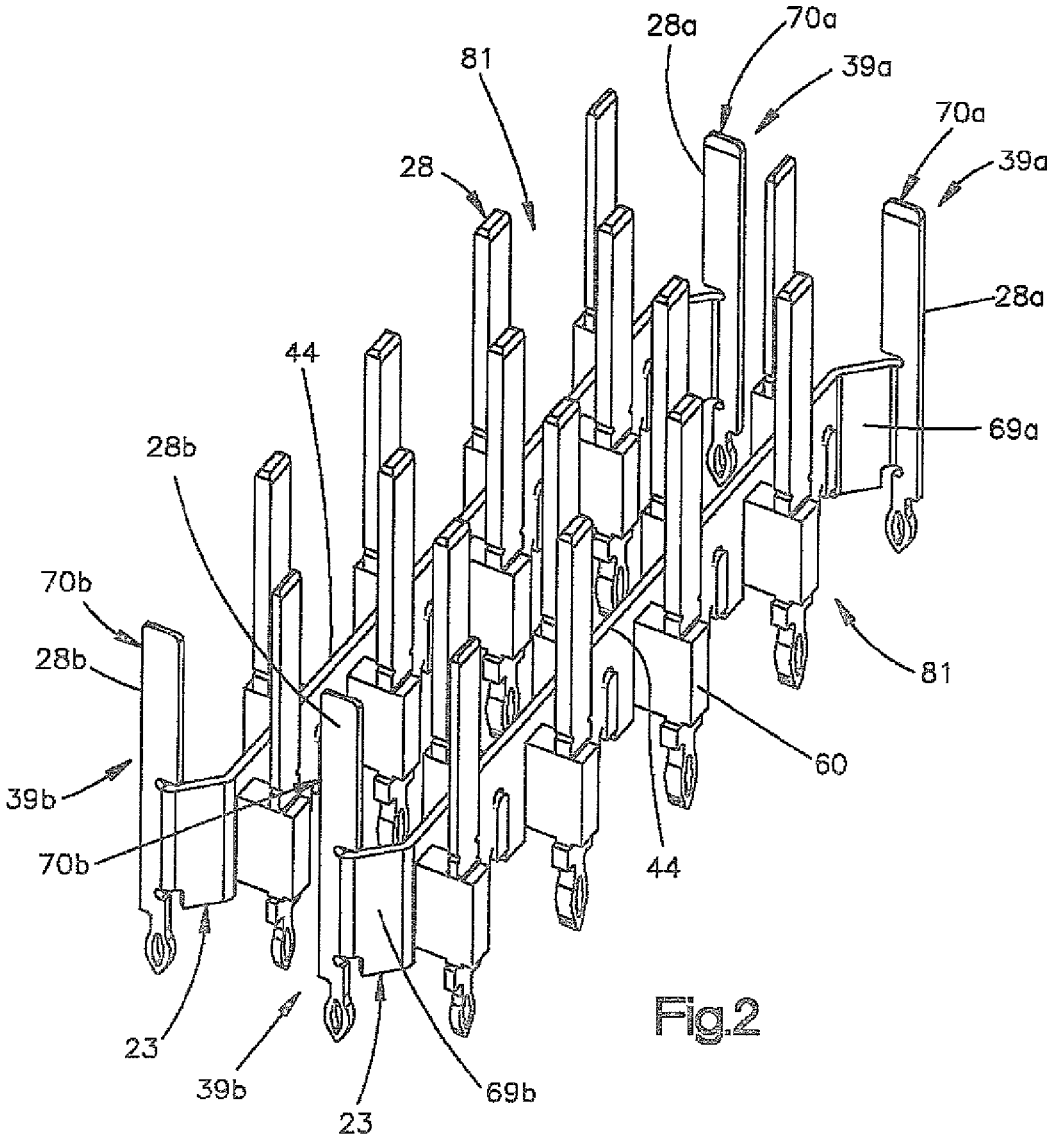
FIG. 2 is a perspective view of a pair of the ground contact networks illustrated in FIG. 1C, each including a ground coupling bar and a plurality of ground contacts.

Referring to FIGS. 1A-2, an electrical connector 20 includes a dielectric or electrically insulative connector housing 22 and a plurality of electrical contacts 38. The connector housing 22 can be made from a dielectric plastic or any suitable alternative material, and defines a frame 36 including a first end wall 32*a* and a second opposed end wall 32*b* spaced from the first end wall 32*a* along a longitudinal direction L, a pair of opposed side walls 30 that are spaced apart along a lateral direction A that is substantially perpendicular to the longitudinal direction L, and are connected between the first and second end walls 32*a-b* so as to define a contact receiving space 37. The connector housing 22 further defines a top end 35*a* and an opposed bottom end 35*b* spaced from the top end 35*a* along a transverse direction T that is substantially perpendicular with respect to the longitudinal direction L and the lateral direction A. In accordance with the illustrated embodiment, the transverse direction T is oriented vertically, and the longitudinal and lateral directions L and A are oriented horizontally, though it should be appreciated that the orientation of the electrical connector 20 may vary during use. Thus, the electrical connector 20 and its components are described herein in the illustrated orientation, it being appreciated that the actual orientation of the electrical connector 20 can vary during use. In accordance with the illustrated embodiment, the end walls 32*a-b* extend upward from the side walls 30.

The connector housing 22 further includes a support wall 50 that supports the electrical contacts 38. The support wall 50 can be disposed proximate to the lower end 35*b* as illustrated, or can alternatively be located anywhere on the connector housing 22 as desired. It should be appreciated that the connector housing 22 can include the support wall 50 which can be integral with the connector housing 22 or otherwise discreetly connected to the side walls 32*a* and 32*b*, such that the support wall 50 can be made of the same electrically insulative material as the remainder of the connector housing 22. The electrical connector 20 defines a mating interface 41 disposed proximate to the top end 35*a* and a mounting interface 43 disposed proximate to the bottom end 35*b*. The electrical connector 20 is configured to be mounted to a complementary electrical component, such as a complementary substrate or printed circuit board, at the mounting interface 43, and is configured to mate with a complementary electrical component, such as a complementary electrical connector, at the mating interface 41.

The electrical connector 20 includes a plurality of electrical contacts 38 that are carried by the connector housing 22 and are at least partially disposed in the contact receiving space 37. The electrical contacts 38 each define respective mating ends 31 and opposed respective mounting ends 33 spaced from the mating ends 31 along the transverse direction T. The mating ends 31 are disposed proximate to the mating interface 41, and are configured to mate with complementary electrical contacts of the complementary electrical component, such as the complementary electrical connector. The mounting ends 33 are disposed proximate to the mounting interface 43, and are configured to electrically connect with complementary electrical traces of the complementary electrical component, such as the complementary substrate or printed circuit board. The mounting ends 33 can define press-fit terminals, surface mounted terminals, or any alternative terminal suitable for connection to the complementary electrical component. In accordance with the illustrated embodiment, the ground contacts 28 each define a ground contact body 57, such that the mounting ends 33 extend down from the contact body 57.

The mounting ends 33 of the electrical contacts 38 are configured to electrically connect with electrical traces of an underlying substrate or printed circuit board when the electrical connector 20 is mounted to the underlying printed circuit board, and the mating ends 31 are configured to electrically connect to complementary electrical contacts of the electrical device to which the electrical connector 20 is mated. Thus, the electrical connector 20 is configured to place the printed circuit board to which the electrical connector 20 is mounted in electrical communication with the complementary electrical device to which the electrical connector 20 is mated.

The mating ends 31 can be configured as blades that are configured to be received in complementary receptacles of the complementary electrical contacts. Thus, the electrical contacts 38 can be referred to as header contacts. Alternatively, the electrical contacts 38 can be configured as receptacle contacts whose mating ends 31 are configured to receive complementary header contacts, or hermaphroditic contacts as desired.

Furthermore, in accordance with the illustrated embodiment, the mating interface 41 is oriented substantially parallel to the mounting interface 43, such that the electrical connector 20 can be referred to as a vertical electrical connector. Alternatively, the electrical connector 20 can be configured as a right-angle electrical connector whereby the mating interface 41 is oriented substantially perpendicular with respect to the mounting interface 43. Likewise, in accordance with the illustrated embodiment, the mating ends 31 are oriented substantially parallel to the mounting ends 33, such that the electrical contacts 38 can be referred to as vertical electrical contacts. Alternatively, the electrical contacts 38 can be configured as right-angle electrical contacts whereby the mating ends 31 are oriented substantially perpendicular with respect to the mounting ends 33.

In accordance with the illustrated embodiment, the electrical contacts 38 can include at least one signal contact 26 such as a plurality of signal contacts 26, and at last one ground contact 28 such as a plurality of ground contacts 28 that can be arranged as desired along respective columns 39 that extend along a longitudinal column direction 47. The columns 39 are spaced apart along a lateral row direction 49 that is angularly offset, such as perpendicular, with respect to the column direction 47. The electrical connector 20 can define a column pitch CP, which is a distance along the column direction 47 between centerlines C of adjacent electrical contacts 38 along the column direction 47. The centerlines C are centrally disposed along the contact body 57 between the mating ends 31 and the mounting ends 33. The electrical connector 20 can further define a row pitch RP, which is a distance between centerlines C of adjacent electrical contacts 38 along the row direction 49. The electrical connector 20 can define as many rows and columns of electrical contacts 38 as desired, such that the electrical contacts 38 are equidistantly spaced along the column and row directions 47 and 49.

In accordance with the illustrated embodiment, adjacent pairs of signal contacts 26 along a respective column 39 can define differential signal pairs 26'. Alternatively, the signal contacts 26 can be single-ended. The ground contacts 28 can be disposed adjacent a signal contact 26, and can be disposed between adjacent signal contacts 26. For instance, the ground contacts 28 can be disposed between adjacent pairs of differential signal pairs 26'. Accordingly, a given ground contact 28 can be disposed between a first pair of adjacent signal contacts 26 and a second pair of adjacent signal contacts 26.

Figure 4A:
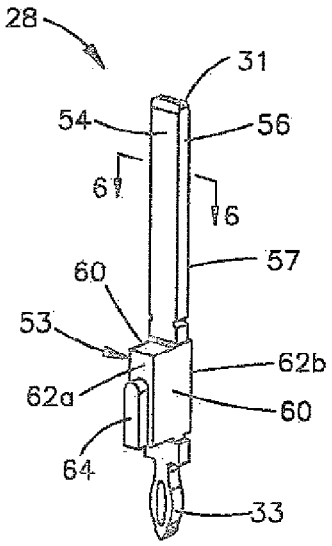
FIG. 4A is a first perspective view of one of the ground contacts illustrated in FIG. 2.
Figure 4B:
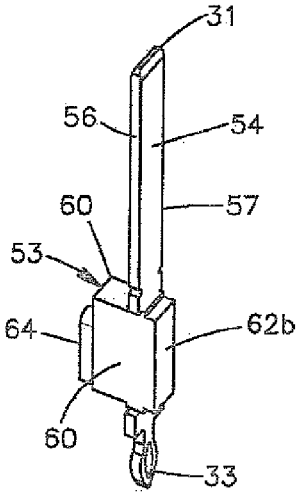
FIG. 4B is a second perspective view of one of the ground contacts illustrated in FIG. 2.
Figure 6:
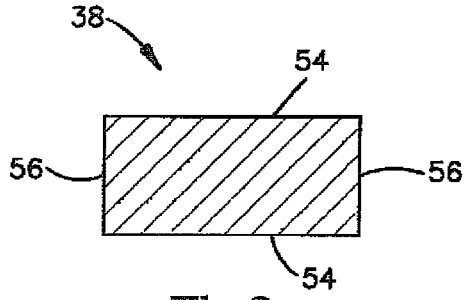
FIG. 6 is a sectional end elevation view of the electrical contact illustrated in FIG. 4A, taken along line 6-6.

Referring also to FIGS. 4A-B and 6, each of the electrical contacts 38 can define respective first and second opposed broadsides 54 and first and second edges 56 connected between the broadsides. The edges 56 define a length less than that of the broadsides 56, such that the electrical contacts 38 define a substantially rectangular cross section. In accordance with the illustrated embodiment, the broadsides 54 extend longitudinally, or along a direction substantially parallel to the column 39. Thus, the edges 56 of adjacent electrical contacts 38, including adjacent signal contacts 26, can face each other along the respective column 39. Accordingly, when the adjacent signal contacts 26 define respective differential pairs, the adjacent signal contacts 26 can be referred to as edge-coupled signal contacts. Alternatively, the signal contacts 26 can be oriented such that the broadsides 54 of adjacent signal contacts 26 of a given differential pair face each other, such that the adjacent signal contacts 26 can alternatively be referred to as broadside-coupled signal contacts.

Figure 3A:
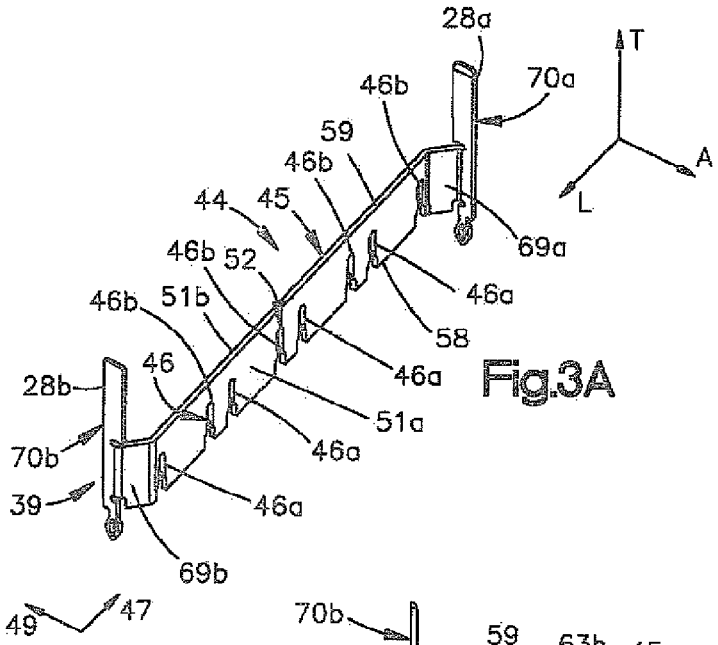
FIG. 3A is a perspective view of one of the ground coupling bars illustrated in FIG. 2.
Figure 3B:
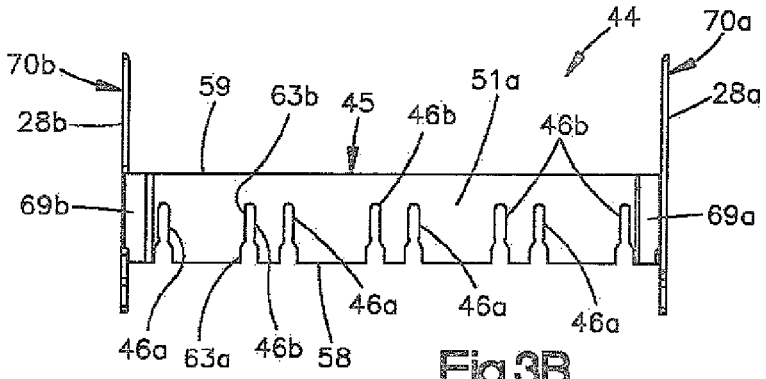
FIG. 3B is a side elevation view of the ground coupling bar illustrated in FIG. 3A.

Referring now to FIGS. 2-4, the electrical connector 20 includes a plurality of ground contact networks 23 that each include respective electrically conductive ground coupling bars 44 that support at least one column 39 of respective ground contacts 28 spaced along the column direction 47. In accordance with the illustrated embodiment, each ground coupling bar 44 is configured to support first and second columns 39 of ground contacts 28. In accordance with the illustrated embodiment, each ground coupling bar 44 includes a body 45 that can be configured as a vertically oriented plate. The ground coupling bar bodies 45 can be made from any suitable electrically conductive material, such as a conductive plastic or metal. Each body 45 defines laterally opposed sides 51*a*-*b* that are configured to support respective ground contacts 28 that can be mounted onto the body 45 in respective adjacent columns 39 so as to place the ground contacts 28 that are mounted onto the body 45 in electrical communication with each other.

Each ground coupling bar 44 includes at least one such as a plurality of engagement members 52 that are configured to engage a complementary at least one such as a plurality of engagement member 53 of at least one such as a plurality of the ground contacts 28 so as to mount the ground contacts 28 onto the ground coupling bar 44. For instance, in accordance with the illustrated embodiment, the ground coupling bar 44 defines a first or lower end 58 and a second or upper end 59 that is spaced from the first or lower end 58 along the transverse direction T, such that the first or lower end 58 is more closely spaced to the mounting ends 33 of the ground contacts 28 than the second or upper end 59 when the ground contacts 28 are mounted to the ground coupling bar 44. Each of the ground coupling bars 44 define the engagement members 52 of the ground coupling bar 44 in the form of a plurality of slots 46 that extend up into the first or lower end 58 of the body 45 toward the second or upper end 59 and terminate short of the second or upper end 59. Alternatively, the slots 46 can extend down into the second or upper end 59 of the body 45 toward the first or lower end 58 and terminate short of the first or lower end 58. Thus, the slots 46 do not extend vertically through the body 45, but rather terminate in the body 45 and define mounting locations for the ground contacts 28. In accordance with the illustrated embodiment, each slot 46 defines a lead-in or a mouth 63*a* at a proximal open end of the slot 46 and a neck 63*b* that defines a distal terminal end of the slot 46. The neck 63*b* can define a lateral thickness less than that of the mouth 63*a*. Otherwise stated, the mouth 63*a* is wider than the neck 63*b*

The engagement member 53 of at least one such as a plurality of the ground contacts 28 can include a conductive mounting block 60 attached to the ground contact body 57. For instance, the mounting block 60 can be overmolded onto or otherwise discreetly attached to or integral with the contact body 57 as desired. Thus, the mounting block 60 can be made from any suitable conductive material, such as a conductive plastic, diecast or plated plastic, metal, conductive lossy material or the like. The mounting block 60 defines a first mounting surface 62*a* and a laterally opposed second surface 62*b*, and a mounting projection 64 that extends out from the first mounting surface 62*a*. In accordance with the illustrated embodiment, the mounting projections 64 extend out from the respective broadsides 54 in a direction substantially perpendicular to the broadsides 54 and parallel to the edges 56.

Figure 5A:
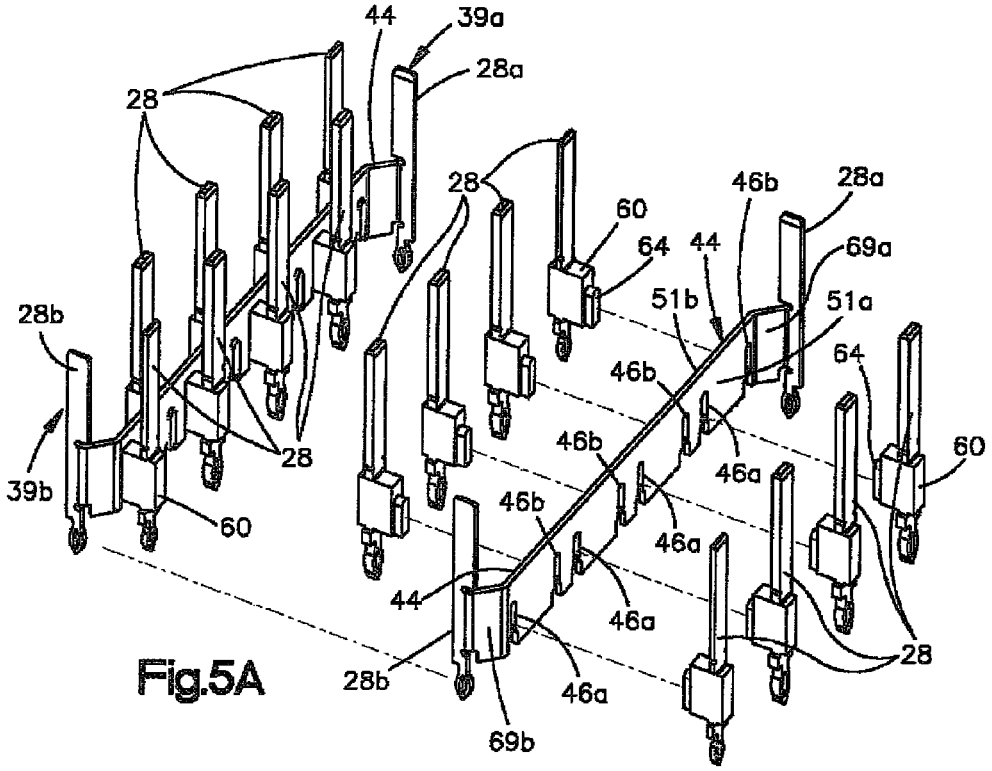
FIG. 5A is an assembly view of one of the ground contact networks illustrated in FIG. 2.
Figure 5B:
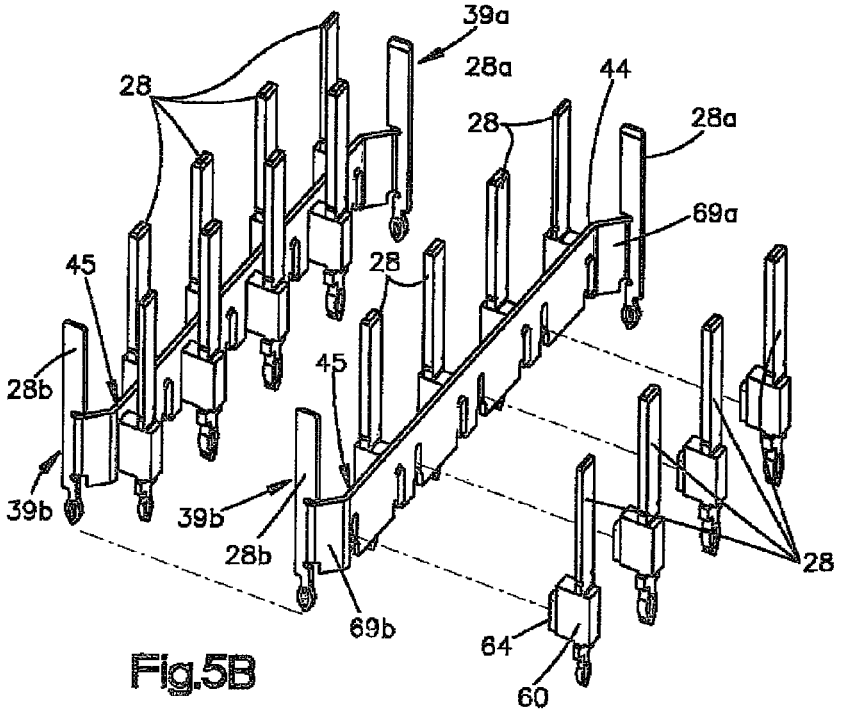
FIG. 5B is another assembly view of the ground contact network illustrated in FIG. 5A.

Referring also to FIGS. 5A-B, the mounting projections 64 define a lateral thickness substantially equal to that of the slot 46 such that the mounting projection 64 can be press-fit or otherwise inserted into respective slots 46 so as to mount the ground contacts 28 onto the ground coupling bar 45, such that the ground contacts 28 can be cantilevered from the ground coupling bar 45. For instance, the first surface 62*a* is attached to the ground coupling bar 45 while the contact body 57 and the second surface 62*b* are cantilevered from the ground coupling bar 45. The lateral thickness of the mounting projections 64 can be less than that of the mouth 63*a* but substantially equal to that of the neck 63*b* such that the mounting projections are press-fit in the necks 63*b* until the outer or upper edge of the mounting projections 64 abut the body 45 of the ground coupling bar 44 at the distal end of the slot 46.

The mounting projection 64 can extend out from the first mounting surface 62*a* any distance as desired, such that the first mounting surface 62 abuts a select one of the laterally opposed sides 51*a-b* of the ground coupling bar body 45. Accordingly, the first mounting surface 62*a* can extend substantially parallel to both the broadside 54 of the ground contacts 28 and the select one of the laterally opposed sides 51*a-b*. The broadsides 54 of the ground contacts 28 thus face the ground coupling bar 44 when the electrical contact 28 is mounted to the ground coupling bar 44. The edges 56 of the ground contacts 56 are thus also oriented substantially perpendicular to the ground coupling bar 44. Accordingly, the edges 56 of the ground contacts 28 face each other along the column direction 47 as well as the edges 56 of the adjacent signal contacts 26 when the ground contacts 28 are mounted to the ground coupling bar 44 and mounted to the connector housing 22. Alternatively, the ground contacts 28 can be oriented such that the broadsides 56 face each other and the broadsides 56 of the adjacent signal contacts 26.

Referring also again to FIG. 1, when the ground contacts 28 are mounted to the ground coupling bar 44, the center of the ground coupling bar 44 is spaced from the centerline C of the electrical contact 28 a distance substantially equal to one-half the row pitch RP. Thus, the mounting blocks 60 are sized so as to space the ground contacts 28 the same distance from the opposed first and second sides 51*a-b*. It should be appreciated that the engagement members 52 and 53 can be alternatively configured as desired so as to mount the ground contacts 28 onto the ground coupling bar 44. For instance, the engagement members 53 of the ground contacts 28 can be projections, and the engagement members 52 of the ground coupling bar 44 can be slots configured to receive the projections so as to mount the ground contacts 28 to the ground coupling bar 44. Alternatively or additionally, at least one or both of the engagement members 52 and 54 can include retention barbs (for instance, that project out from the projection and/or into the slot) that facilitate securement of the ground contacts 28 to the ground coupling bar 44. Alternatively or additionally still, one or more up to all the ground contacts 28 can be integral with the ground coupling bar 44. For instance, each ground contact network 23 can include one or more outer ground contacts 28*a* and 28*b* along the column direction 47 that are integrally connected to the ground coupling bar 44.

In accordance with the illustrated embodiment, a first at least one such as a plurality of ground contacts 28 is mounted to the first side 51*a* of the ground coupling bar 44 in the manner described above along a first column 39*a*, and a second at least one such as a second plurality of ground contacts 28 is mounted to the second side 51*b* of the ground coupling bar in the manner described above along a second column 39*b*. The ground coupling bar body 45, and thus the ground coupling bar 44, thus places the ground contacts 28 of each column 39*a* and 39*b* in electrical communication with each other along the respective column 39 or column direction 47, and further places the ground contacts 28 of the first column 39*a* in electrical communication with the ground contacts 28 of the second column 39*b*. Thus, the ground coupling bar 44 places the ground contacts 28 that are mounted to the ground coupling bar 44 in electrical communication both along the column direction 47 and the row direction 49. The electrical connector 20 can include a plurality of ground contact networks 23 so as to define a plurality of first and second columns 39*a* and 39*b* that are alternatingly arranged along the row direction 49.

In accordance with the illustrated, engagement members 52 or slots 46 of the ground coupling bar 44 are arranged as a first plurality of engagement members 52 such as a first plurality of slots 46*a*, such that the first plurality of ground contacts 28 of the first column 39*a* are mounted to the first plurality of engagement members 52 or slots 46*a* at the first side 51*a*, and a second plurality of engagement members 52 such as a second plurality of slots 46*b*, such that the second plurality of ground contacts 28 of the second column 39*b* are mounted to the second plurality of engagement members 52 or slots 46*b* at the second side 51*b*. Thus, a first at least one such as a plurality of ground contacts 28 can be attached in the first plurality of slots 46*a*, respectively, so as to mount the ground contacts 28 onto the first side 51*a* of the ground coupling bar 44, and a second at least one such as a plurality of ground contacts 28 can be attached in the second plurality of slots 46*b*, respectively, so as to mount the ground contacts 28 onto the second side 51*b* of the ground coupling bar 44. Adjacent slots 46 of the first plurality of slots 46*a* are spaced apart a distance that can be any multiple of the column pitch CP as desired such that at least one such as any desired number of signal contacts 26 can be disposed between adjacent ground contacts 28 along the column direction 47. For instance, adjacent slots 46 of the first plurality of slots 46*a* can be spaced apart a distance three times greater than the column pitch CP, such that a pair of signal contacts 26 can be disposed between the adjacent ground contacts 28.

Likewise, a second plurality of ground contacts 28 can be attached in the second plurality of slots 46*b*, respectively, so as to mount the ground contacts 28 onto the second side 51*b* of the ground coupling bar 44. The slots 46 of the second plurality of slots 46*b* are spaced apart a distance that can be any multiple of the column pitch CP as desired such that at least one such as any desired number of signal contacts 26 can be disposed between adjacent ground contacts 28 along the column direction 47. For instance, adjacent slots 46 of the second plurality of slots 46*b* can be spaced apart a distance three times greater than the column pitch CP, such that a pair of signal contacts 26 can be disposed between the adjacent ground contacts 28.

The mounting block 60 provides a stand-off along the row direction that spaces the respective ground contact 28 from the ground coupling bar 44. Accordingly, the ground contact networks 23 define gaps 81 disposed between adjacent ground contacts 28 along the column direction 47 that are configured to receive the signal contact 26 such that the signal contacts can be equidistantly spaced from the adjacent ground contacts 28, and can further be spaced from the ground coupling bar 44. Accordingly, the signal contacts 26 are positioned so as to be electrically isolated from the ground contacts 28 and the ground coupling bar 44. Furthermore, because the connector housing 22 is electrically insulative, the signal contacts 26 are electrically isolated from the ground contacts 28, while the ground contacts 28 of each ground contact network 23 are electrically commoned, or in electrical communication with each other, along the column direction 47 as well as along the row direction 49.

It should thus be appreciated that certain components of the electrical connector 20 can be electrically conductive so as to place the ground contacts 28 in electrical communication with each other, and certain components of the electrical connector 20 can be electrically insulative so as to electrically isolate the ground contacts 28 from the signal contacts 26, and further to electrically isolate the signal contacts 26 from each other as well as from the ground contacts 28. The electrically insulative components of the electrical connector 20, such as the support wall 50 alone or in addition to the remainder of the connector housing 22, can be wholly insulative or conductive with an insulative portion that isolates the electrical contacts 36 from each other when the electrical contacts 36 are mounted to the connector housing 22. The insulative portion can be made from any suitable insulating material, such as a plastic or nonconductive lossy material, such as an Eccosorb® material commercially available from Emerson & Cuming. As described above, the ground coupling bar 44, and in particular the ground coupling bar body 45, and a portion of the connector housing 22, can be made from any suitable conductive material, and for instance can be diecast or otherwise formed from any suitable conductive metal, made from any suitable conductive plastic or made from a conductive lossy material as desired. It should further be appreciated that a portion of the conductive ground coupling bar can be made from an electrically insulative material, and a portion of the ground coupling bar that is in contact with the ground contacts 28 can be made from an electrically conductive material. For instance, the conductive portion of the ground coupling bar 44 can be a layer disposed on or embedded in insulative material of the support wall ground coupling bar 44, alone or in combination with a conductive plating in the aperture in the ground coupling bar 44 that receives the ground contacts 28 and is electrically coupled to the layer so as to place the ground contacts 28 in electrical communication with each other.

Figure 10:
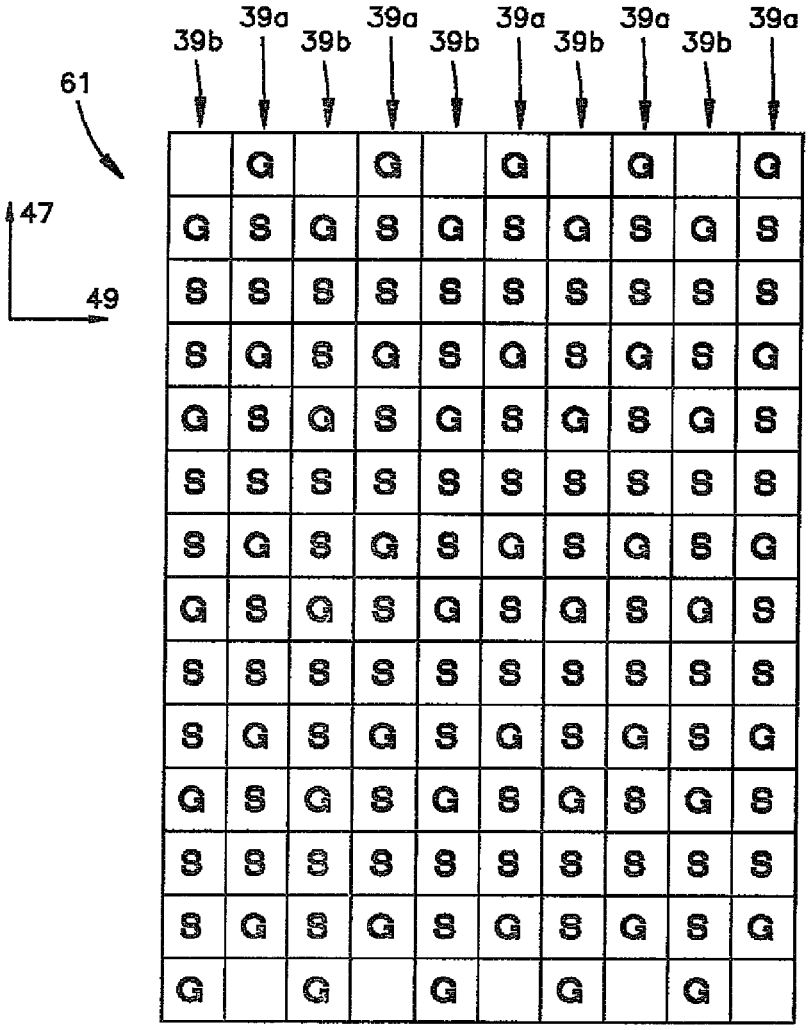
FIG. 10 is a schematic illustration of a footprint defined by the array of electrical contacts illustrated in FIG. 1.
Figures 7A, 7B:
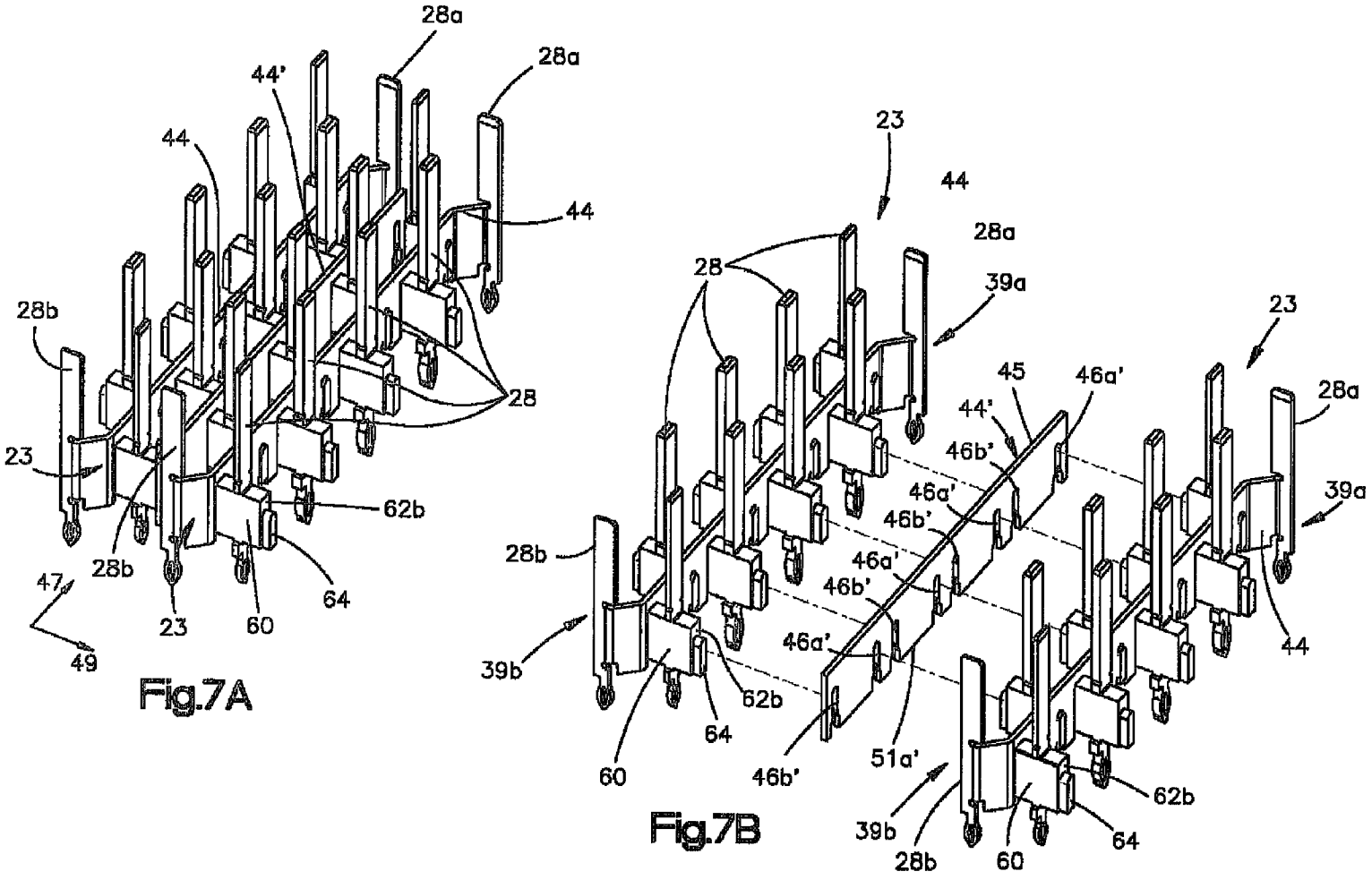
FIG. 7A is a perspective view of the pair of ground contact networks illustrated in FIG. 2, along with an auxiliary ground coupling bar configured to electrically connect the ground contacts of the ground contact networks.
FIG. 7B is an assembly view of the pair of ground contact networks and the auxiliary ground coupling bar illustrated in FIG. 7A.
Figure 8A:
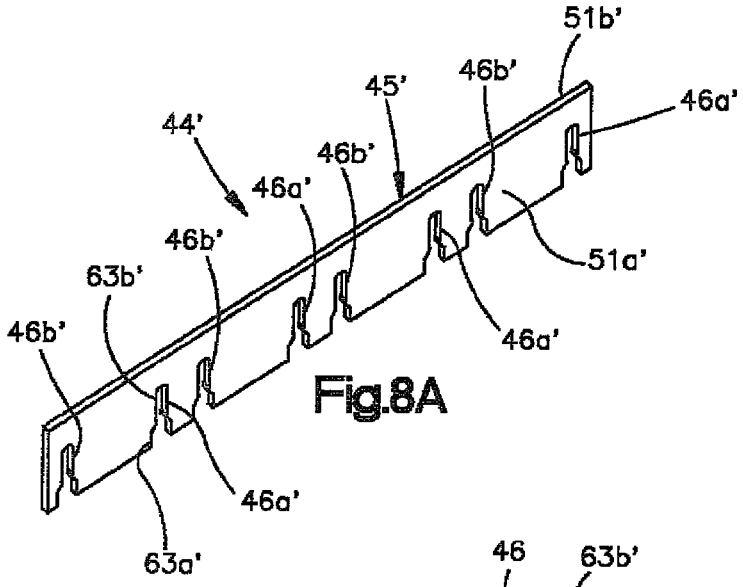
FIG. 8A is a perspective view of the auxiliary ground coupling bar illustrated in FIG. 7A.
Figure 8B:
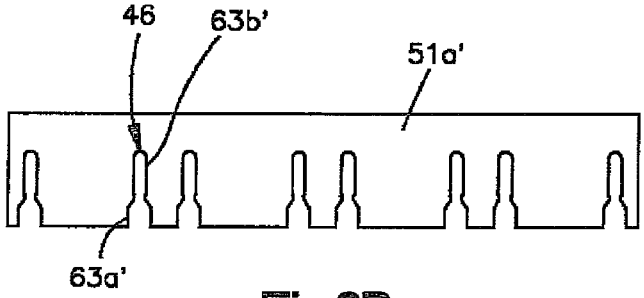
FIG. 8B is a side elevation view of the auxiliary ground coupling bar illustrated in FIG. 8A.
Figure 9:
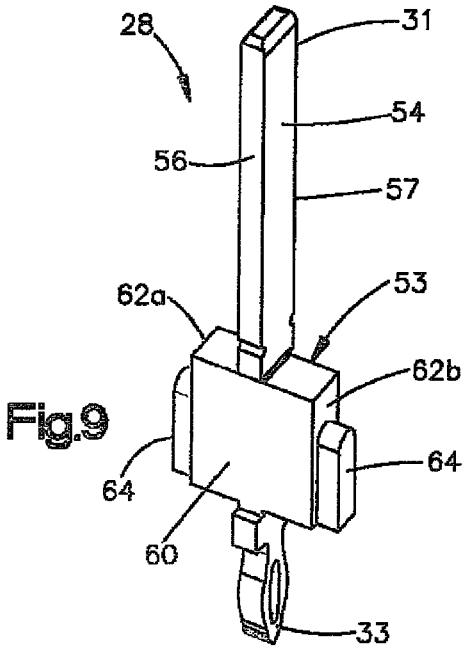
FIG. 9 is a perspective view of one of the electrical contacts illustrated in FIG. 7A.

Referring also to FIG. 10, the electrical contacts 38 are arranged in an array 61 having a footprint defined by the columns 39 including the first plurality of columns 39*a* and the second plurality of columns 39*b* that are disposed adjacent to each other along the row direction 49, such that the first and second pluralities of columns 39*a* and 39*b* are alternatingly arranged along the row direction 49. In accordance with the illustrated embodiment, the ground contacts 28 of each column 39 are arranged in a repeating S-S-G pattern along the column direction 47, such that the ground contacts 28 of at least one up to all of the plurality of first columns 39*a* can be longitudinally staggered or offset along the column direction 47 with respect to at least one up to all of the ground contacts 28 of the plurality of second columns 39*b*. Accordingly, at least a first column 39*a*, such as the plurality of first columns 39*a*, can define a repeating S-S-G pattern, while at least a second column 39, such as the plurality of second columns 39*b*, can define a repeating S-S-G pattern that is offset with respect to the first plurality of columns 39*a* by any distance as desired, such as the column pitch CP, or one or more electrical contacts 38. The electrical connector 20 can further include respective outer ground contacts 28*a* and 28*b* at each column 39 located longitudinally outward of the longitudinally outermost signal contact S.

For instance, at least one up to all of the ground coupling bars 44 can include first and second longitudinally opposed outer ends 69*a-b*, respectively, extend obliquely out from the respective ground coupling bar body along the column direction 47 and along the row direction 49 in opposite directions toward the respective columns 39*a* and 39*b*. Each outer end 69*a* and 69*b* can carry a respective outer ground contact 28*a* and 28*b* that are aligned with the respective ground contacts 28 of the columns 39*a* and 39*b*. For instance, referring again to FIGS. 2-4, the outer ground contacts 28*a* and 28*b* can be mounted to the outer ends 69*a* and 69*b* in any manner described above, and are integral with the outer ends 69*a* and 69*b* of the ground coupling bar in accordance with the illustrated embodiment. The outer ground contacts 28*a* and 28*b* can be oriented such that their opposed broadsides 54 are spaced from each other along the column direction 47. Accordingly the broadsides of the outer ground contacts 28*a* and 28*b* are oriented so as to face the edges 56 of the adjacent signal contacts 26 along the column direction.

Thus, each of the columns 39*a* and 39*b* can define first and second longitudinally opposed outer ends 70*a* and 70*b*. The outer ground contacts 28 of one of the first and second ends 70*a-b* of a select one of the first and second pluralities of columns 39*a* and 39*b* can be outwardly recessed with respect to the outer ground contact 28 of the other of the columns 39*a* and 39*b* along the column direction 47, while the outer ground contacts 28 of opposed outer end of the select one of the first and second pluralities of columns 39*a* and 39*b* is inwardly recessed with respect to the respective outer end of the other of the first and second pluralities of columns 39*a* and 39*b* along the column direction 47.

For instance, in accordance with the illustrated embodiment, the outer ground contact 28*a* of the first outer end 70*a* of each of the first plurality of columns 39*a* is outwardly recessed with respect to the outer ground contact 28*a* at the first outer end 70*a* of each of the second plurality of columns 39*b*, and the outer ground contact 28*b* at the second outer end 70*b* of each of the first plurality of columns 39*a* is inwardly recessed with respect to the outer ground contact 28*b* at the second outer end 70*b* of each of the second plurality of columns 39*b*.

It should thus be appreciated that while the ground contact networks 23 can define the same repeating S-S-G pattern of electrical contacts 38, the patterns can begin proximate to at opposite ends 70*a* and 70*b* of the respective columns 39*a* and 39*b* and extend in opposite directions along the respective columns 39*a* and 39*b*. Otherwise stated, the contact pattern of at least one first column 39*a* such as the first plurality of columns 39*a* along a first direction can be the same as the contact pattern of at least one second column 39*b* such as the second plurality of columns 39*b* along a second direction that is opposite the first direction. Alternatively, the first and second ground contact networks 23, and the first and second columns 39*a-b*, can define the same contact pattern along the same direction from the first outer end 70*a* to the second outer end 70*b*, or can define different contact patterns as desired. The electrical contacts 36 can define an pattern that is staggered from column to column, such that the columns 39*a* can define a repeating G-S-S-G-S-S pattern from the first outer end 70*a* along the column direction 47 toward the second outer end 70*b*, and the columns 39*b* can define a repeating S-S-G-S-S-G pattern from the first outer end 70*a* along the column direction 47 toward the second outer end 70*b*.

As described above, each of the first and second pluralities of columns 39*a* and 39*b* can be offset from each other along their respective column direction 47 by the column pitch CP. Accordingly, a select ground contact 28 such as each ground contact 28 of a respective column 39 is inline with a signal contact 26 of an immediately adjacent column 39 along the row direction 49. It should be appreciated, alternatively, that the columns 39*a* and 39*b* can alternatively be offset by any dimension as desired. Alternatively still, the columns 39*a* and 39*b* can be inline with each other, such that the signal contacts 26 of each column 39*a* and 39*b* are aligned along the row direction 49, and each of the ground contacts 28 of each column 39*a* and 39*b* are aligned along the row direction. While each of the first and second pluralities of column 39*a* and 39*b* defines the same repeating S-S-G pattern of signal contacts 26 and ground contacts 28 along the respective column 39, the columns can alternatively define different contact patterns as desired.

In accordance with the illustrated embodiment, at least one up to all of the first plurality of slots 46*a* are offset with respect to at least one up to all of the second plurality of slots 46*b* along the column direction 47. Accordingly, the first plurality of slots 46*a* are configured to receive the ground contacts 28 of the first column 39*a*, and the second plurality of slots 46*b* are configured to receive the ground contacts 28 of the second column 39*b*. Alternatively, the first and second slots 46*a* and 46*b* could be aligned along the row direction 49 such that the ground contacts 28 of the first and second columns 39*a* and 39*b* are inline with each other along the row direction. For instance the first slots 46*a* can extend into the first side 51*a* of the ground coupling bar 44, and the second slots 46*b* can extend into the second side 51*b* of the ground coupling bar 44.

It should thus be appreciated that each ground coupling bar 44 can support a first column 39*a* of electrical ground contacts 28 on one lateral side of the ground coupling bar 44, and a second column 30*b* of electrical ground contacts 28 on a laterally opposed side of the ground coupling bar 44. The ground coupling bars 44 can be laterally spaced along the connector housing base 34 such that the columns of ground contacts 28 are spaced laterally apart an equal distance. Because the ground coupling bar 44 is electrically conductive, all ground contacts 28 mounted onto a common ground coupling bar 44 are electrically commoned, or placed in electrical communication with each other.

Alternatively, each first and second laterally opposed side 51*a* and 51*b* of the ground coupling bar 44 can be electrically conductive, and the opposed lateral sides 51*a* and 51*b* are electrically insulated from each other such that the ground contacts 28 of each column 39 are electrically commoned, but insulated from the column of ground contacts 28 mounted onto the opposed lateral side of the ground coupling bar 44. Alternatively still, the ground contact networks 23 can be configured such that only one column of electrical ground contacts 28 is supported on each ground coupling bar 44.

Referring now again to FIGS. 1A-2, the support wall 50 supports the electrical contacts 38. In accordance with the illustrated embodiment, the support wall 50 directly supports the signal contacts 26 and the ground contacts 28 such that the signal and ground contacts 26 and 28 are in direct physical contact with the support wall 50. Alternatively, the support wall 50 can indirectly support the ground contacts 28. For instance, the support wall 50 can support the ground coupling bars 44, which in turn support the ground contacts 28. The support wall 50 is electrically insulative so as to prevent electrical signals from traveling across the electrical contacts 38 through the connector housing 22.

In accordance with the illustrated embodiment, the connector housing 22 defines a first plurality of apertures 80 and a second plurality of apertures 82 that extend through the support wall 50. The first plurality of apertures 80 are configured to receive the ground contacts 28 of the ground contact networks 23, and the second plurality of apertures 82 is configured to individually receive the corresponding signal contacts 26. The apertures 80 and 82 are spaced apart from each other along the column direction 47 and the row direction 49 so as to correspond positionally to the array 61 of electrical contacts 36.

For instance, each of the first and second pluralities of apertures 80 and 82 can be sized slightly less than or substantially equal to the cross-sectional dimension of the ground contacts 28 and signal contacts 26, respectively, such that the contacts 26 and 28 are press-fit in the support wall 50 inside the respective apertures 80 and 82. The first plurality of apertures 80 can be sized and shaped the same or differently than the second plurality of apertures 82 depending, for instance, on the corresponding size of the signal contacts 26 and ground contacts 28. For instance, the apertures 82 can be sized greater than the apertures 80, such that the apertures 80 and 82 are keyed to selectively accept the ground contacts 28 and signal contacts 26, respectively. For instance, the ground contacts 28 can be sized so as to fit in the apertures 82, but sized to be to fit in the apertures 80.

When the electrical contacts 38 are supported by the support wall 50, the respective mating ends 31 of the electrical contacts 38 extend above the support wall 50, and the mounting ends 33 are disposed below the support wall 50. The mating ends 31 of the ground contacts 28 can be inline with the mating ends 31 of the signal contacts 26, and the mounting ends 33 of the ground contacts 28 can be inline or offset with respect to the mounting ends 33 of the signal contacts 26. As described above, differential signal pairs 26' can be disposed in the gaps 81 (see FIG. 2) disposed between adjacent ground contacts 28 along the column direction 47 when the electrical contacts 36 are mounted to the connector housing 22.

The ground contact networks 23, and thus the ground contacts 28, are mounted to the connector housing 22 by inserting the upper mating ends 31 of the respective ground contacts 28 up through the respective apertures 82 until the ground coupling bars 44 abut the lower end of the support wall 50, or can alternatively extend into respective slots formed in the lower end of the support wall 50, such that the ground contacts 28 are attached to the support wall 50 in the respective apertures 82. The signal contacts 28 are mounted to the connector housing 22 by inserting the upper mating ends 31 of the respective signal contacts 26 individually up through the respective apertures 80 such that the signal contacts 26 are press-fit in the apertures 80, such that the signal contacts 26 are attached to the support wall 50 in the respective apertures 80. The signal contacts 26 and/or the ground contacts 28 can include stops that abut the lower end of the support wall 50 when fully mounted to the connector housing 22.

The connector housing 22 can define slots 86 that extend from the bottom end 35*b* of the first and second end walls 32*a* and 32*b* up along the end walls 32*a-b*. For instance, the slots 86 can be aligned with, and sized to receive, the outer ground contacts 28*a-b* of the first and second pluralities of ground contact networks 23. Accordingly, a first plurality of slots 86 can extend into the first end wall 32*a* at locations adjacent the first outer end 70*a* of the first columns 39*a* and thus configured to receive outer ground contacts 28*a*, and a second plurality of slots 86 can extend into the second end wall 32*b* at locations adjacent the second outer end 70*b* of the second columns 39*b* and thus configured to receive outer ground contacts 28*b*. Accordingly, the slots 86 can define a lateral width substantially equal to the broadsides 54 of the respective outer ground contacts 28*a-b*, such that the broadsides 54 are recited in the slots 86 as the ground contact networks 23 are mounted to the connector housing 22.

As described above, the ground contact networks 23 includes a first plurality of ground contacts 28 in electrical communication with each other along a first column 39*a*, and a second plurality of ground contacts 28 in electrical communication with each other along a second column 39*b*. Referring to FIGS. 7A-9, the electrical connector 20 can be further configured to place at least one such as a plurality of the ground contacts 28 of at least a first and a second ground contact network 23 such as a plurality of ground contact networks in electrical communication with each other. Thus, while a ground contact bar 44 places the ground contacts 28 of a pair of columns 39*a* and 39*b* in electrical communication, the electrical connector 20 is further configured to place the ground contacts 28 of a plurality greater than a pair of columns 39*a* and 39*b* in electrical communication with each other.

For instance, the electrical connector 20 can include at least one such as a plurality of auxiliary ground coupling bars 44' that are configured to electrically connect to the second surfaces 62*b* of the ground contacts 28 of adjacent columns 39*a* and 39*b* of ground contacts 28 of a pair of adjacent ground contact networks 23 that are thus mounted to a pair of adjacent ground coupling bars 44. Thus, the ground coupling bars 44 can be referred to as primary ground coupling bars 44 that place first and second columns of ground contacts 28 in electrical communication, and the auxiliary ground coupling bars 44' can electrically connect to at least one such as a plurality of ground contacts 28 of adjacent columns 39*a* and 39*b* that are mounted to a pair of adjacent primary ground coupling bars 44. The electrical connector can include as many auxiliary ground coupling bars 44' as desired so as to place as many columns 39 of ground contacts 28 in electrical communication along the row direction 49 as desired. Thus, the auxiliary conductive ground coupling bar 44' is connected to a first plurality of ground contacts of the first column 39*a* of a first one of a pair of ground contact networks 23 to a second plurality of ground contacts of the second column 39*b* of the other of the pair of ground contact networks 23.

For instance, each auxiliary ground coupling bar 44' can be constructed as described above with respect to the primary ground coupling bars 44, however the auxiliary ground coupling bars 44' can be devoid of the outer ends 69*a-b*. Thus, the auxiliary ground coupling bars 44' can include at least one such as a plurality of engagement members 52 that are configured to engage a complementary at least one such as a plurality of engagement member 53 of at least one such as a plurality of the ground contacts 28 so as to mount the ground contacts 28 onto the auxiliary ground coupling bar 44*a*. For instance, in accordance with the illustrated embodiment, the auxiliary ground coupling bar 44' defines a first or lower end 58' and a second or upper end 59' that is spaced from the first or lower end 58*a* along the transverse direction T, such that the first or lower end 58' is more closely spaced to the mounting ends 33 of the ground contacts 28 than the second or upper end 59' when the ground contacts 28 are mounted to the auxiliary ground coupling bar 44*a*. Each of the auxiliary ground coupling bars 44' define the engagement members 52 of the auxiliary ground coupling bar 44' in the form of a plurality of slots 46' that extend up into the first or lower end 58' of the auxiliary ground coupling bar body 45' toward the second or upper end 59' and terminate short of the second or upper end 59*a*. Alternatively, the slots 46' can extend down into the second or upper end 59' of the body 45' toward the first or lower end 58' and terminate short of the first or lower end 58*a*. Thus, the slots 46' do not extend vertically through the body 45*a*, but rather terminate in the body 45' and define mounting locations for the ground contacts 28. In accordance with the illustrated embodiment, each slot 46' defines a mouth 63*a'* at a proximal open end of the slot 46' and a neck 63*b'* that defines a distal terminal end of the slot 46'. The neck 63*b'* can define a lateral thickness less than that of the mouth 63*a'*.

The engagement members 53 of the ground contacts 28 can include the conductive mounting block 60 as described above. Each of the mounting blocks 60 can further include a mounting projection 64*a* that extends out from the second mounting surface 62*b* and defines a lateral thickness substantially equal to that of the slots 46' such that the mounting projections 64*a* can be press-fit or otherwise inserted into respective slots 46' so as to mount the ground contacts 28 onto the auxiliary ground coupling bar 44'. Accordingly, the ground contacts 28 of adjacent ground contact networks 23 can be mounted onto the opposed sides of the auxiliary ground coupling bar 45'. The mounting projections 64*a* can be spaced from the centerline of the respective ground contacts 28 a distance substantially equal to the distance between the mounting projections and the centerline. Furthermore, the slots 46' can include a first plurality of slots 46*a'* and a second plurality of slots 46*b'* as described above with respect to the primary ground coupling bar 44. Accordingly, the slots 46' are aligned with the engagement members 53 or mounting projections 64*a* of the ground contacts 28. It should be appreciated that the auxiliary ground coupling bars 44' can alternatively be mounted onto the ground contacts in any manner as desired.

The auxiliary ground coupling bar 44' is electrically conductive, and can be made from any suitable electrically conductive material, such as a conductive plastic or metal. Accordingly, the auxiliary ground coupling bar 44' establishes an electrical path between the ground contacts 28 mounted onto different primary ground coupling bars 44. As a result, one or more, up to all, of the ground contacts 28 can be placed in electrical communication regardless of whether they are mounted onto the same primary ground coupling bar 44.

Referring also to FIG. 10, the array 61 of electrical contacts 38 includes an array of ground contacts 28 spaced along the column direction 47 and the row direction 49, and an array of signal contacts 26 spaced along the column direction 47 and the row direction 49, such that select ground contacts 26 are disposed between select adjacent signal contacts 28. Otherwise stated, the array 61 of electrical contacts 38 is arranged in a plurality of columns 39 that extend along a respective column direction 47, wherein the columns 39 are spaced along a row direction 49 that extends substantially perpendicular to the column direction 47, and each of the columns 39 includes a plurality of signal contacts 26 and a plurality of ground contacts 28. The electrical connector 20 places the ground contacts 28 of the array 61 of electrical contacts 38 in electrical communication along the column direction 47, and can place the ground contacts 26 of at least a pair of adjacent columns 39*a* and 39*b* in electrical communication, while electrically isolating the signal contacts 26 of the array 61 of electrical contacts 38 from the ground contacts 28.

The electrical connector 20 can further electrically couple as many columns 39 of electrical contacts 26 as desired along the row direction 49, for instance by attaching the auxiliary ground coupling bars 44*a* to adjacent ground contact networks 23. Accordingly, it should be appreciated that the ground contacts 28 are electrically isolated from the plurality of signal contacts 26 along the respective column 39, and the plurality of ground contacts 28 of each column 39 are in electrical communication with each other and with the ground contacts 28 of the other columns 39. For instance, the ground contact networks 23 can include select ones of the array of signal contacts 26 and select ones of the array of ground contacts 28 of the array 61 of electrical contacts 38, such that the select ones of the ground contacts 26 are in electrical communication with each other.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims.

What is claimed:

1. An electrical connector comprising:

an electrically insulative connector housing;

a plurality of signal contacts supported by the connector housing; and a ground contact network including an electrically conductive ground coupling bar defining first and second opposed sides, a plurality of ground contacts mounted to the first side of the ground coupling bar in a first column, and a plurality of ground contacts mounted to the second side of the ground coupling bar in a second column, wherein the ground coupling bar places each of the plurality of ground contacts mounted to the first side in electrical communication with each other, further places each of the plurality of ground contacts mounted to the second side in electrical communication with each other, and further places each of the plurality of ground contacts mounted to the first side in electrical communication with each of the plurality of ground contacts mounted to the second side.

2. The electrical connector as recited in claim 1, wherein the plurality of ground contacts mounted to the first side of the ground coupling bar are spaced along a column direction, and the plurality of ground contacts mounted to the second side of the ground coupling bar are spaced along the column direction, and the plurality of ground contacts that are mounted to the first side of the ground coupling bar are offset with respect to the ground contacts that are mounted to the second side of the ground coupling bar along the column direction.

3. The electrical connector as recited in claim 2, wherein ground contact network defines a gap disposed between an adjacent pair of the plurality of ground contacts along the column direction that is configured to receive a pair of the signal contacts.

4. The electrical connector as recited in claim 3, wherein the pair of the signal contacts defines a differential signal pair.

5. The electrical connector as recited in claim 1, wherein the ground coupling bar comprises a body and a pair of opposed outer ends that extend obliquely from opposed ends of the body in opposite directions so as to define first and second outer ground contacts that are aligned with the first and second columns of ground contacts, respectively.

6. The electrical connector as recited in claim 5, wherein the plurality of ground contacts of the first and second columns define opposed edges and opposed broadsides that are longer than the edges, such that the edges of each of the plurality of ground contacts of the first and second columns, respectively, face each other.

7. The electrical connector as recited in claim 6, wherein each of the outer ground contacts defines opposed edges and opposed broadsides that are longer than the edges, such that the broadsides of each of the outer contacts face the edge of an adjacent ground contact.

8. The electrical connector as recited in claim 1, wherein the ground coupling bar comprises a body and defines a plurality of slots extending into the body, and the ground contacts comprise a mounting projection that is press-fit in a respective one of the slots so as to mount the plurality of ground contacts to the ground coupling bar.

9. The electrical connector as recited in claim 1, wherein the ground contact network is a first ground contact network, and the electrical connector further comprises a second ground contact network and an auxiliary conductive ground coupling bar that electrically connects at least one ground contact of the first ground contact network with at least one ground contact of the second ground contact network.

10. The electrical connector as recited in claim 9, wherein the ground contacts each comprise a pair of mounting projections, a first one of the pair of mounting projections press-fit into a respective slot of the ground coupling bar and a second one of the pair of mounting projections press-fit into a respective slot of the auxiliary ground coupling bar.

11. An electrical connector comprising:

a connector housing;

a plurality of ground contacts and a plurality of signal contacts supported by the connector housing and spaced apart in a column direction and a row direction that is substantially perpendicular to the column direction; and an electrically conductive ground coupling bar that is attached to select ones of the plurality of ground contacts along the row direction, and further attached to select others of the plurality of ground contacts along the column direction, thereby placing the select ones of the plurality of ground contacts in electrical communication with each other along the row direction, and further along electrical communication with the select others of the plurality of ground contacts along the column direction, wherein the ground contacts are electrically isolated from the signal contacts.

12. The electrical connector as recited in claim 11, wherein adjacent ones of the plurality of signal contacts along the column direction define a plurality of differential signal pairs.

13. An electrical connector comprising:

an insulative connector housing supporting a plurality of signal contacts; and a pair of ground contact networks supported by the connector housing, each of the ground contact networks including 1) a conductive ground coupling bar that defines a first side and an opposed second side, and 2) a first plurality of ground contacts mounted to the first side and arranged in a first column and in electrical communication with each other, and a second plurality of ground contacts mounted to the second side and arranged in a second column and in electrical communication with each other.

14. The electrical connector as recited in claim 13, further comprising an auxiliary conductive ground coupling bar connected to the first plurality of ground contacts of one of the pair of ground contact networks, and further connected to the second plurality of ground contacts of the other of the pair of ground contact networks.

15. An electrical connector comprising:

an electrically insulative connector housing;

a plurality of signal contacts supported by the connector housing; and a ground contact network including an electrically conductive ground coupling bar defining first and second opposed sides, a plurality of ground contacts mounted the first side of the ground coupling bar in a first column, and a plurality of ground contacts mounted to the second side of the ground coupling bar in a second columns, the ground coupling bar comprising a body and defining a plurality of slots extending into the body, and each of the pluralities of ground contacts comprising a mounting projection that is press-fit in a respective one of the slots so as to mount the plurality of ground contacts to the ground coupling bar, wherein the ground coupling bar places each of the plurality of ground contacts mounted to the first side in electrical communication with each other, further places each of the plurality of ground contacts mounted to the second side in electrical communication with each other, and further places each of the plurality of ground contacts mounted to the first side in electrical communication with each of the plurality of ground contacts mounted to the second side.

16. The electrical connector as recited in claim 15, wherein the plurality of ground contacts mounted to the first side of the ground coupling bar are spaced along a column direction, and the plurality of ground contacts mounted to the second side of the ground coupling bar are spaced along the column direction, and the plurality of ground contacts that are mounted to the first side of the ground coupling bar are offset with respect to the ground contacts that are mounted to the second side of the ground coupling bar along the column direction.

17. The electrical connector as recited in claim 16, wherein the ground contact network defines a gap disposed between an adjacent pair of the plurality of ground contacts along the column direction that is configured to receive a pair of the signal contacts.

18. The electrical connector as recited in claim 17, wherein the pair of the signal contacts defines a differential signal pair.

19. The electrical connector as recited in claim 15, wherein the ground contact network is a first ground contact network, and the electrical connector further comprises a second ground contact network and an auxiliary conductive ground coupling bar that electrically connects at least one ground contact of the first ground contact network with at least one ground contact of the second ground contact network.

* * * * *